United States Patent [19]

Couvrette

[11] Patent Number: 4,911,087

[45] Date of Patent: Mar. 27, 1990

[54] SELF BANKING KIOSK

[76] Inventor: Edward Couvrette, 585 Vernon Way, El Cajon, Calif. 92020

[21] Appl. No.: 286,216

[22] Filed: Dec. 19, 1988

[51] Int. Cl.[4] ..... G07G 5/00

[52] U.S. Cl. ..... 109/24.1; 109/2; 109/48; 52/67

[58] Field of Search ..... 109/2, 9, 24.1, 48, 109/49, 49.5, 58, 64, 81; 52/65, 67, 71

[56] References Cited

U.S. PATENT DOCUMENTS

| | | | |
|---|---|---|---|
| 4,399,755 | 8/1983 | Wiedmann | 109/2 |
| 4,417,527 | 11/1983 | Williams et al. | 109/2 |
| 4,513,670 | 4/1985 | Berman | 109/24.1 |
| 4,577,562 | 3/1986 | Berman | 109/24.1 |
| 4,603,643 | 8/1986 | Couvrette | 109/2 X |
| 4,649,832 | 3/1987 | Hain et al. | 109/24.1 |
| 4,681,044 | 7/1987 | Dallman | 109/48 X |
| 4,813,475 | 3/1989 | Couvrette | 109/24.1 X |

*Primary Examiner*—Gary L. Smith
*Assistant Examiner*—Suzanne L. Dino
*Attorney, Agent, or Firm*—Frank D. Gilliam

[57] ABSTRACT

An access door system for a narrow profile enclosure for housing an automatic teller machine (ATM) which allows servicing of the teller machine from within the enclosure for enhanced security for the contents of the ATM and service technician safety. The enclosure includes a door that is hinged and pivots along one vertical end surface allowing the opposite vertical edge surface to rotate away from the enclosure side surface through 30 degrees of rotation. The vertical edge surface includes a perpendicular rectilinear end wall of the same height fixedly attached at a location slightly spaced from the vertical edge surface which extends inwardly from and perpendicular thereto. The rectangular end wall is either a solid panel or has a pivotal door for enclosure entry therethrough.

16 Claims, 1 Drawing Sheet

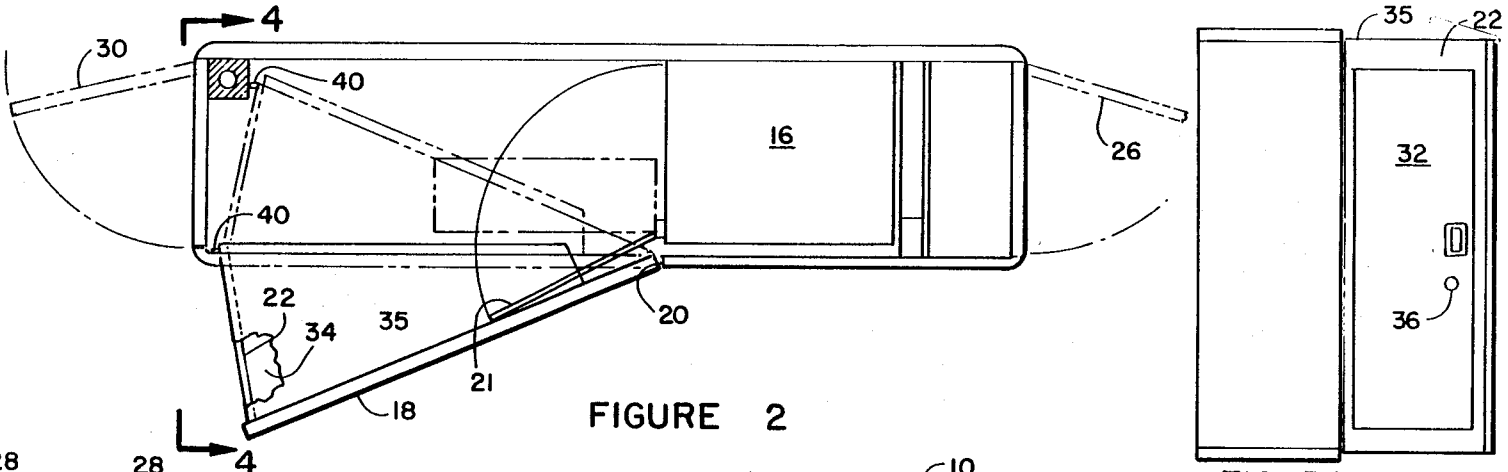
FIGURE 4
FIGURE 2
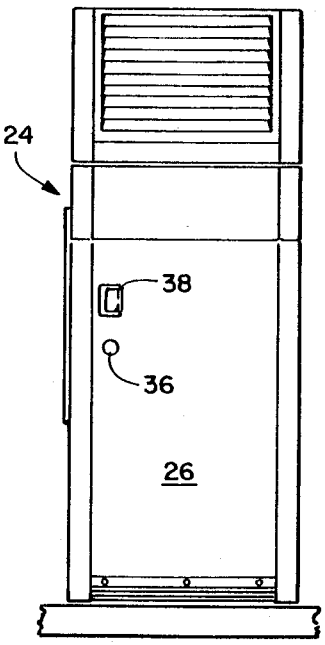
FIGURE 5
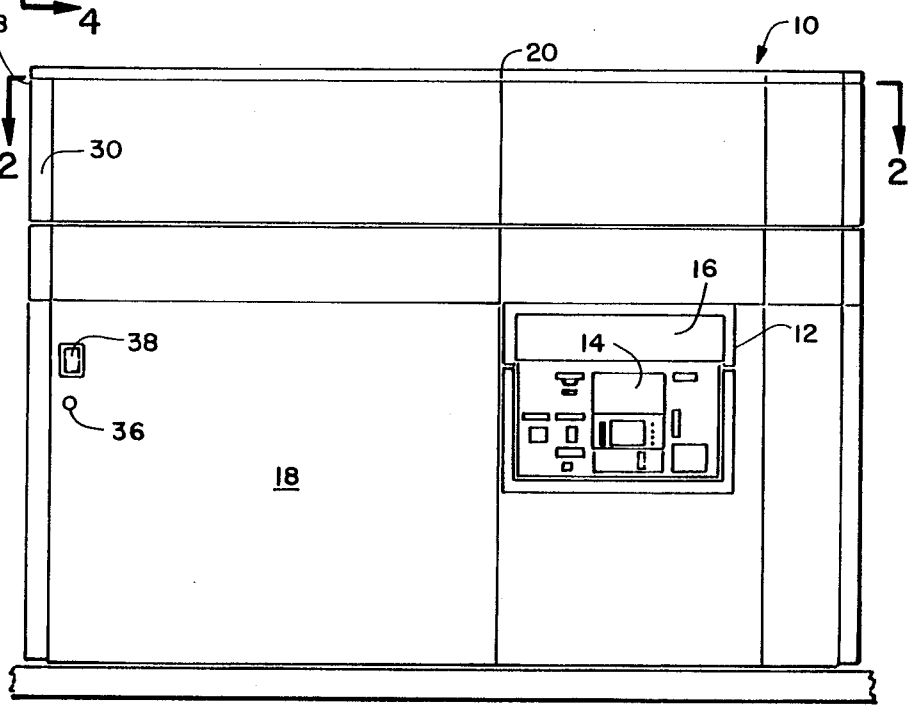
FIGURE 1
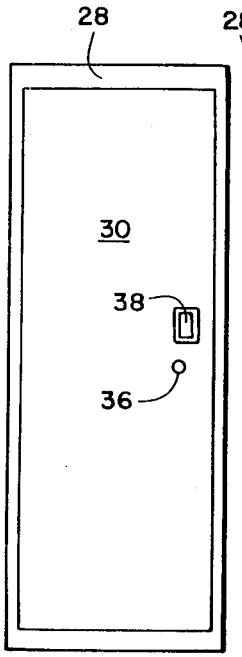
FIGURE 3

SELF BANKING KIOSK

BACKGROUND OF THE INVENTION

The invention is directed to a kiosk associated with self service banking and more particularly, it relates to a kiosk which has a sufficiently narrow profile for use in automobile drive up operations or other convenient locations. The automobile drive up locations are generally located on a narrow isle between adjacent driveways and the ATM within the kiosk either contains a considerable amount of money or is being refilled with a considerable amount of money or serviced by one or more technicians within the confines of the kiosk while maintaining a minimum increased kiosk side profile.

U.S. Pat. No. 4,649,832 issued Mar. 17, 1987 to inventors David A. Hain et al. and U.S. Pat. No. 4,681,044 teach such a kiosk with a quarter cylinder in the side wall for outward rotation for excising the ATM. One side of the quarter cylinder is rectilinear to mate and aline with the side of the kiosk when in a closed non-ATM servicing position and the other exposed side when the quarter cylinder is rotated for ATM serving is curvilinear to allow rotation of the quarter panel and yet maintain the sealed integrity of the kiosk. In these teachings the quarter cylinder must necessarily rotate substantially 90 degrees because the ATM contained in the kiosk requires that the safe door be rotated substantially 180 degrees for servicing. As taught by these references, the safe door when rotated for servicing becomes parallel with the inside of the rectilinear wall surface of the quarter cylinder necessitating at least 90 degrees of rotation of the quarter cylinder.

There are currently ATMs that do not require that the safe door be rotated substantially 180 degrees to obtain access to the interior thereof for repair or restocking of money. The use of the prior art kiosk designed as described in the above referenced patents provides considerable unnecessary width to the kiosk when rotated substantially 90 degrees for the servicing of those ATMs that do not require that the safe door be rotated 180 degrees.

The kiosk of the instant invention fills the void in state of the art kiosk designs. The kiosk of the invention accommodates the newly designed ATMs and further reduces the overall width of the kiosk when service of the ATM by one or more technicians is required.

SUMMARY OF THE INVENTION

The kiosk of the invention includes an overall rectangular configuration well known in this art. At least one end of the kiosk has a door which can be opened to service the electrical components of the ATM. In one embodiment of the kiosk of the invention, the opposite end of the kiosk also includes a door for entry into the interior of the kiosk by the technicians for servicing or restocking the ATM with money. The planar kiosk front side which includes the customer access to the ATM includes a pivotable panel which conforms to the plane of the kiosk side and can be rotated from the kiosk side wall plane between 0 to 40 degrees of rotation to allow the ATM safe side access door to be rotated sufficiently to allow entry of one or more technicians for supplying or servicing. In the embodiment of the invention the kiosk does not have the interior access door on the opposite end from the electrical servicing door. In another embodiment the second access door to the interior of the kiosk is located in a rectilinear panel which is fixedly attached to the inner surface of the pivotable panel positioned perpendicular thereto. The rectilinear panel provides a closure for the opening created by the pivoting of the pivotable panel to allow the safe door of the ATM to be rotated open. The small degree of rotation required of the side panel to allow access to the interior of the ATM allows a smaller overall extension of the kiosk while serving.

An object of this invention is to provide a kiosk which will accommodate the newly designed ATMs which does not require the safe door to be rotated a full 180 degrees for interior access.

Another object of this invention is to provide a kiosk which has a minimum width profile when the ATM is being serviced.

Additional objects, features and advantages of this invention will become apparent to those skilled in the art upon consideration of the following detailed description of the preferred embodiments exemplifying the best modes of carrying out the invention as presently perceived. The detailed description particularly refers to the accompanying drawing Figures in which:

BRIEF DESCRIPTION OF THE DRAWING FIGURES

FIG. 1 is a front elevation of the kiosk of the invention;

FIG. 2 is a top plan view thereof taken along line 2—2 showing the side panel rotated for internal ATM access;

FIG. 3 is a left end view of FIG. 1;

FIG. 4 is a view taken along line 4—4 of FIG. 2;

FIG. 5 is a right end view of FIG. 1.

DETAILED DESCRIPTION OF THE PREFERRED EMBODIMENTS

Referring now to the drawing FIGS. 1–5. FIG. 1 is a front elevation of the kiosk 10 of the invention. The front surface of the kiosk comprises a opening 12 through which the controls 14 of the ATM 16 are exposed for customer access. To the left of the ATM in the Figure is an access panel 18 which pivots along elongated hinge pivot 20 outwardly from the plane of the front surface of the kiosk. This panel 18 normally rotates from between 0 and 40 degrees to allow the safe door to be rotated approximately 90 degrees and to provide additional space for up to two people to work conveniently within the normally narrow profile kiosk, see FIG. 2. An inwardly extending wall panel 22 which is angled slightly toward the elongated hinge pivot 20 is fixedly attached to the inner surface of the access panel 18. The wall panel 22 provides a closure for the opening created between the distal end surface of the panel 18 and the side wall of the kiosk when the panel 18 is pivoted outward from the side of the kiosk regardless of the rotational position of the panel 18. The wall panel 22 prevents unwanted access through the created opening when the kiosk is being serviced.

The right hand end 24 of the kiosk, as shown in FIGS. 1 and 5, includes an interior access door 26 which when pivoted outwardly to an open position, as shown in FIG. 2, allows a technician access to the electrical support system for the ATM which includes the kiosk lighting, ATM power, etc.

The left hand end 28 of the kiosk of the FIG. 1 and 3 embodiment also includes a 90 degree rotatable door 30 for access to the interior of the kiosk for access to the ATM for servicing, supplying with money and removing deposits therefrom.

In the second embodiment of the kiosk, see FIG. 4, the rotatable door 30 is not required because a rotatable entry door 32 is provided in the wall panel 22 for the same purpose as rotatable door 30.

The ATM 16 as shown in FIGS. 1 and 2 includes an internal safe door 21 which must be opened by technicians for required access to the interior of the ATM for servicing and supplying the bank therein with money. Although the safe door of the ATM shown in FIG. 2 is only required to be rotated 90 degrees for access to the interior of the safe which would not necessitate any expansion of the kiosk walls, as explained above, it is impossible for more than one person to enter and work within the kiosk with all access doors closed without expanding a kiosk exterior side wall.

A service shelf 34 is provided on the inner surface of the wall panel 22 for the temporary placement of tools, money or the like when servicing the ATM. A cover 35 seals any access though the top of the space which exists when the panel 18 is rotated into the FIG. 2 and 4 position.

A stop member 40, carried by the panel 22 may be employed to limit the rotation of door 18 to approximately 40 degrees maximum.

All of the access panels have the normally required locks and opening handles as for example key lock 36 and recessed access handle 38, see FIG. 1 and 3–5.

Although the invention has been described in detail with reference to preferred embodiments and specific examples, variations and modifications exist within the scope and spirit of the invention as described and defined in the following claims:

What is claimed is:

1. An access system for access to an ATM enclosure defining an interior space and having a planar front surface defining a plane and containing an ATM that includes a safe door that must rotate away from said ATM for servicing thereof and end walls substantially perpendicular to said planar front, the system comprising:

a panel rotatable from a closed position to an open position having a hinged edge and an opening edge and having a first vertical height that lies in said plane when said panel is in a closed position;

a rectilinear wall having said first vertical height fixedly attached to said panel and extending toward said interior space, the distal end surface thereof being angled toward said hinged edge, said wall providing a covering surface between said planar surface and said open edge when said panel is pivoted between said closed and any open position;

said panel when pivoted from a closed position to an open position providing a chamber outside of said enclosure and adjacent to said plane defined by said front surface that is in direct communication with the interior space to permit said safe door to rotate sufficiently to provide access to service said ATM; and a first door through said enclosure to provide access to said interior space thereof.

2. The invention as defined in claim 1 wherein said safe door rotates approximately 90 degrees and said panel door rotates between 0 and 40 degrees.

3. The invention as defined in claim 2 additionally comprises a stop means for terminating the rotation of said panel beyond said 40 degrees.

4. The invention as defined in claim 1 wherein said first door is located in one of said end panels.

5. The invention as defined in claim 4 additionally comprising a second door in the opposite one of said end panels for access to the electrical system of said ATM.

6. The invention as defined in claim 1 additionally comprising means for securing said panel and doors in their closed positions.

7. The invention as defined in claim 5 additionally comprising means for securing said second door in a closed position.

8. The invention as defined in claim 1 wherein said first door is located in said wall.

9. An access system for access to an ATM enclosure defining an interior space and having a planar front surface defining a plane and containing an ATM that includes a safe door that must rotate away from said ATM for servicing thereof and end walls substantially perpendicular to said planar front, the system comprising:

a panel rotatable from a closed position to an open position having a hinged edge and an open edge and having a first vertical height that lies in said plane when said panel is in a closed position;

a wall having said first vertical height fixedly attached to said panel and extending toward said interior space, the distal end surface thereof being angled toward said hinged edge, said wall providing a covering surface between said planar surface and said open edge when said panel is pivoted between said closed and any open position;

said panel when pivoted from a closed position to an open position providing a chamber outside of said enclosure and adjacent to said plane defined by said front surface that is in direct communication with the interior space to permit said safe door to rotate sufficiently to provide access to service said ATM;

a first door through said enclosure to provide access to said interior space thereof; and said safe door rotates approximately 90 degrees and said panel door rotates between 0 and 40 degrees.

10. The invention as defined in claim 9 additionally comprises a stop means for terminating the rotation of said panel beyond said 40 degrees.

11. The invention as defined in claim 9 wherein said first door is located in one of said end panels.

12. The invention as defined in claim 9 additionally comprising a second door in opposite one of said end panels for access to the electrical system of said ATM.

13. The invention as defined in claim 9 additionally comprising means for securing said panel and doors in their closed positions.

14. The invention as defined in claim 12 additionally comprising means for securing said second door in a closed position.

15. The invention as defined in claim 9 wherein said first door is located in said wall.

16. The invention as defined in claim 9 wherein said wall is rectilinear.

* * * * *